US012778282B2

(12) United States Patent
Reim et al.

(10) Patent No.: US 12,778,282 B2
(45) Date of Patent: Nov. 3, 2026

(54) PIECE OF FURNITURE

(71) Applicant: Sedus Systems GmbH, Geseke (DE)

(72) Inventors: Andreas Reim, Herford (DE); Mirko Nordheim, Burgwald Bottendorf (DE)

(73) Assignee: Sedus Systems GmbH, Geseke (DE)

( * ) Notice: Subject to any disclaimer, the term of this patent is extended or adjusted under 35 U.S.C. 154(b) by 359 days.

(21) Appl. No.: 18/688,822

(22) PCT Filed: Sep. 13, 2022

(86) PCT No.: PCT/EP2022/075349
§ 371 (c)(1),
(2) Date: Mar. 4, 2024

(87) PCT Pub. No.: WO2023/046525
PCT Pub. Date: Mar. 30, 2023

(65) Prior Publication Data

US 2025/0120502 A1 Apr. 17, 2025

(30) Foreign Application Priority Data

Sep. 22, 2021 (DE) ..... 10 2021 124 503.6

(51) Int. Cl.
*A47B 47/00* (2006.01)
*A47B 57/34* (2006.01)
(Continued)

(52) U.S. Cl.
CPC ..... *A47B 47/0083* (2013.01); *A47B 57/34* (2013.01); *A47B 96/063* (2013.01);
(Continued)

(58) Field of Classification Search
CPC ... A47B 47/0083; A47B 57/34; A47B 96/063; A47B 96/1433; A47B 47/00;
(Continued)

(56) References Cited

U.S. PATENT DOCUMENTS 3,932,047 A * 1/1976 Crossan ..... F16B 9/09 403/387
3,981,250 A * 9/1976 Anthony ..... A47B 57/26 108/106
(Continued)

FOREIGN PATENT DOCUMENTS

| | | |
|---|---|---|
| DE | 71 38 336 U | 1/1972 |
| EP | 0 406 547 A2 | 1/1991 |
| JP | H05-027055 Y2 | 7/1993 |

OTHER PUBLICATIONS

International Search Report in PCT/EP2022/075349, mailed Jan. 9, 2023.

*Primary Examiner* — Devin K Barnett
(74) *Attorney, Agent, or Firm* — Collard & Roe, P.C.

(57) ABSTRACT

A piece of furniture has polygonal shelves and vertical supporting posts, wherein each shelf is connected in each of its corner regions to a respective supporting post. The supporting posts have, over their height, corner cutouts, into which corner connectors are inserted in a form-fitting and/or force-fitting manner, wherein each corner connector engages around a corner region of a shelf and is fastened on the upper side and/or underside of the shelf.

12 Claims, 7 Drawing Sheets

Figures 1A, 1B, 1C, 1D:
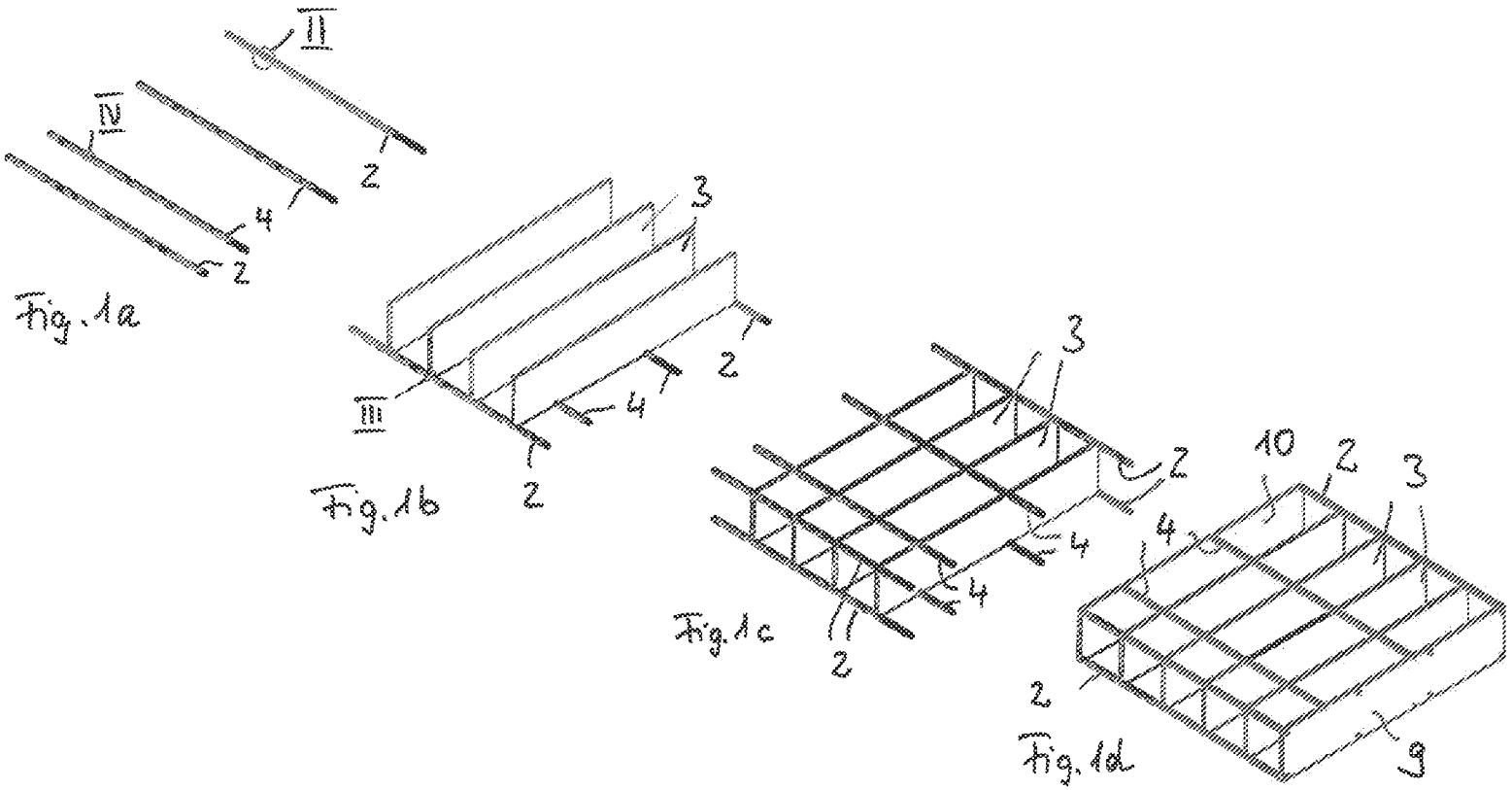

(51) Int. Cl.
*A47B 96/06* (2006.01)
*A47B 96/14* (2006.01)
*A47B 47/02* (2006.01)
*A47B 57/06* (2006.01)

(52) U.S. Cl.
CPC ..... *A47B 96/1433* (2013.01); *A47B 47/021* (2013.01); *A47B 57/06* (2013.01)

(58) Field of Classification Search
CPC ... A47B 47/005; A47B 47/021; A47B 47/027; A47B 57/06; A47B 57/20; A47B 46/027
See application file for complete search history.

(56) References Cited

U.S. PATENT DOCUMENTS 4,515,280 A * 5/1985 Sheu ..... A47B 47/0033 211/186
4,585,365 A * 4/1986 Manno ..... F16B 12/20 403/231
4,846,079 A * 7/1989 Ajax ..... F16B 12/52 248/188
5,348,170 A * 9/1994 Thornley ..... A47B 57/20 211/187
5,622,120 A * 4/1997 Yeh ..... A47B 13/021 108/158
5,628,256 A * 5/1997 Lazarus ..... A47B 47/0083 403/375
D499,281 S * 12/2004 Yamaguchi ..... D6/675.1
D503,053 S * 3/2005 Yamaguchi ..... D6/712
D506,625 S * 6/2005 Yamaguchi ..... D6/712
9,420,883 B2 * 8/2016 Lai ..... A47B 47/0016
10,362,861 B1 * 7/2019 Patton ..... A47B 13/003
10,905,235 B2 * 2/2021 Chiao ..... A47B 61/00
D915,801 S * 4/2021 Davis ..... D6/675.1
11,241,092 B1 * 2/2022 Liu ..... A47B 96/1458
D1,032,256 S * 6/2024 Xu ..... D6/675.1
2017/0303687 A1 10/2017 Tan
2020/0355210 A1 11/2020 Koo

* cited by examiner

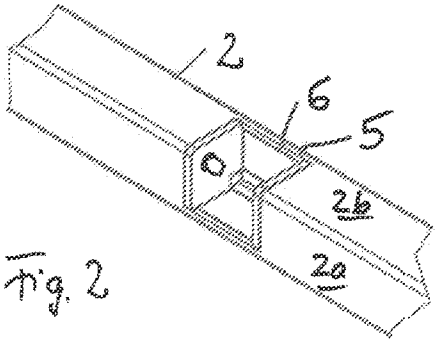
Fig. 2
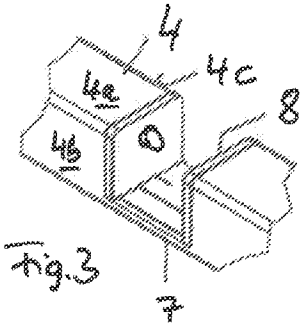
Fig. 3
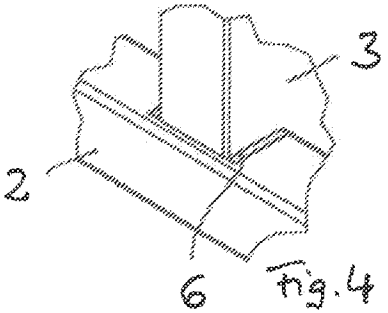
Fig. 4
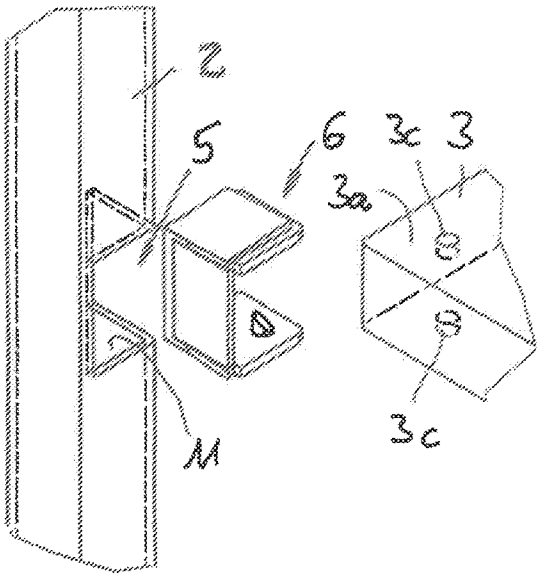
Fig. 5a
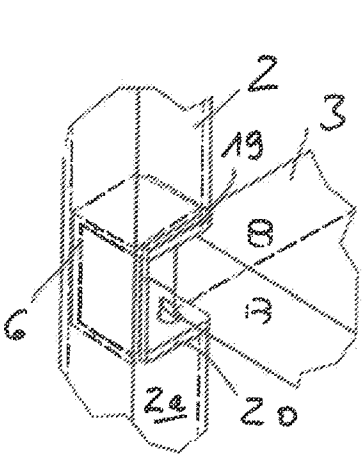
Fig. 5b
Fig. 5c
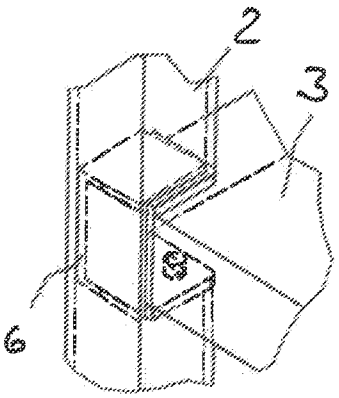
Fig. 5d 4
3
8

4
3
26
8
27

3
4
8
28

29
29
3b
8
4
4c
7
4b
13
4a 23
26
27
30
30
24
14
28a
28
14

23
26
27
23b
30
30
23c
24
14
28a
23a
28
25
14

PIECE OF FURNITURE

CROSS REFERENCE TO RELATED APPLICATIONS

This application is the National Stage of PCT/EP2022/075349 filed on Sep. 13, 2022, which claims priority under 35 U.S.C. § 119 of German Application No. 10 2021 124 503.6 filed on Sep. 22, 2021, the disclosure of which is incorporated by reference. The international application under PCT article 21(2) was not published in English.

The invention relates to a piece of furniture having polygonal shelves and vertical supporting posts, wherein each shelf is connected, in each of its corner regions, to a supporting post, in each instance.

Pieces of furniture of this type, in particular in the form of a shelf unit, are known in many varied embodiments. Pieces of furniture or shelf units having individual supporting posts, which are connected with one another by way of the shelves, are known as what are called modular shelving systems. In this regard, the corner regions of the modular shelves are screwed onto the corresponding modular shelf or, alternatively, inserted into it. Such modular shelving systems generally consist of metal and are used in storage spaces, basements, or the like, but not in the office or residential sector.

In the office or residential sector, shelf units having a closed carcass are generally used, in the side walls of which drilled holes are provided in at least two rows, distributed over the height, into which holes pin-like supporting elements are inserted, on which elements an individual shelf unit shelf rests. From DE 71 38 336 U, a carcass-shaped shelf unit having special connection elements is known, which elements engage around the planar shelf unit elements. Furthermore, shelf units for the residential and office sector are also known, which have open side parts, each having two supporting posts connected with one another, which posts have drilled holes for the insertion of pin-like supporting elements, distributed over their height, on which elements the shelves rest, wherein additional fastening elements are also provided between the shelves and side parts.

It is the task of the invention to create a stable piece of furniture having individual supporting posts and shelves, which is easy to assemble and is suitable for the office or residential sector.

This task is accomplished, in the case of a piece of furniture of the type indicated initially, in that the supporting posts have corner cutouts over their height, into which corner connectors are inserted with shape fit and/or force fit, wherein each corner connector engages around a corner region of a shelf and is fastened on the upper side and/or underside of the shelf.

During assembly, the corner connector, in each instance, which preferably consists of plastic, is inserted into a corner cutout of a supporting post, and held in it with shape fit and/or force fit. In this regard, the corner connector can, depending on its design, be connected with the shelf ahead of time, or only after insertion of the corner connector into the corner cutout. In this way, a stable, easy to assemble connection is formed, which is hardly visible. This produces an optically appealing impression of the piece of furniture, so that it is particularly suitable for the office or residential sector.

In an advantageous embodiment, it is provided that the supporting post, in each instance, is formed by a hollow profile, which consists, for example, of aluminum.

When using a hollow profile as the supporting post, it is particularly advantageous that the corner connector, in each instance, has a wall region, on the upper side and/or underside, that engages, with shape fit and/or force fit, into a hollow space of the hollow profile of the supporting post, which space borders on the corner cutout. This wall region is dimensioned in such a manner that it engages into the hollow profile, preferably in a resilient or elastic manner, at least in certain regions.

If the piece of furniture has rectangular shelves, it is provided that the supporting post, in each instance, has a rectangular cross-section, and the corner cutout, in each instance, is formed by free cuts of two adjacent side walls.

To connect the corner connector to the shelves, it is preferably provided, according to a first embodiment, that the corner connector, in each instance, has a crosspiece on the upper side and/or underside, which is directed inward to the shelf, and engages into a corresponding dead-end bore of the shelf. The corner connector is then simply set onto the corner region of the shelf, and the crosspiece engages into the dead-end bore of the shelf, with a locking effect. Before that, the corner connector can already have been inserted into the corner cutout of the supporting post.

Alternatively, according to a second embodiment, it can be provided that the corner connector, in each instance, has a push-through opening on the upper side and/or underside, through which a fastening screw is screwed into the shelf. The corner connector is then set onto a corner region of a shelf, and subsequently fastened in place on the shelf with at least one fastening screw. Accommodation openings for the fastening screws are then preferably pre-drilled in the corner regions of the shelf.

In a particularly preferred embodiment, it is provided that the corner connector, in each instance, is configured in two parts, with a basic body that engages around the corner region of a shelf, and an outer body, wherein the basic body has side walls, a cover wall, and a shelf wall, and the outer body engages around the basic body on the outside, and has a wall region, on the upper side and underside, in each instance, that engages into the hollow space of the hollow profile of the supporting post, with shape fit and/or force fit. The basic body is then essentially stable in shape, and the outer body has wall regions that are configured to be elastic or resilient, which make engagement with shape fit and/or force fit possible.

Furthermore, it is preferably provided that the corner connector, in each instance, has side edges, the outer sides of which lie flush with the related side wall of the supporting post.

If the shelves require greater support because of their size, it is advantageous if additional supporting posts are provided, which have side cutouts over their height, into which side connectors are inserted with shape fit and/or force fit, wherein each side connector engages around a side edge of a shelf and is attached to the shelf on the upper side and/or underside.

Preferably, the additional supporting post, in each instance, is formed by a hollow profile, and the side connector, in each instance, has a wall region, on the upper side and/or underside, which engages into a hollow space of the hollow profile of the additional supporting post that borders on the side cutout, with shape fit and/or force fit. The additional supporting post, in each instance, can consist of aluminum.

The additional supporting post, in each instance, then preferably has a rectangular cross-section, and the side cutout, in each instance, is formed by means of free cuts of three side walls.

According to a first preferred embodiment, it is provided that the side connector, in each instance, has a crosspiece directed inward toward the shelf on the upper side and/or underside, which crosspiece engages into a corresponding dead-end bore of the shelf. The side connector is then simply set onto the shelf from the side, and the crosspiece engages into the dead-end bore of the shelf, locking it in place. Previously, the side connector can already have been inserted into the side cutout of the supporting post.

Alternatively, according to a second embodiment, it can be provided that the side connector, in each instance, has a push-through opening on the upper side and/or underside, through which opening a fastening screw is screwed into the shelf. The side connector is then set onto a shelf from the side, and subsequently fastened to the shelf using at least one fastening screw. At the side edges of the shelf, accommodation openings for the fastening screws are then preferably pre-drilled.

Finally, it is particularly preferably provided that the side connector, in each instance, is configured in two parts, with a side basic body that engages around a side edge of a shelf, and a side outer body, wherein the side basic body has a side wall, a cover wall, and a shelf wall, and the side outer body engages around the side basic body on the outside, and has a wall region, on the upper side and underside, that engages into the hollow space of the hollow profile of the additional supporting post, in each instance, with shape fit and/or force fit. The side basic body is then essentially stable in shape, and the side outer body has wall regions that are configured to be elastic or resilient, which regions allow engagement with shape fit and/or force fit.

Figure 7:
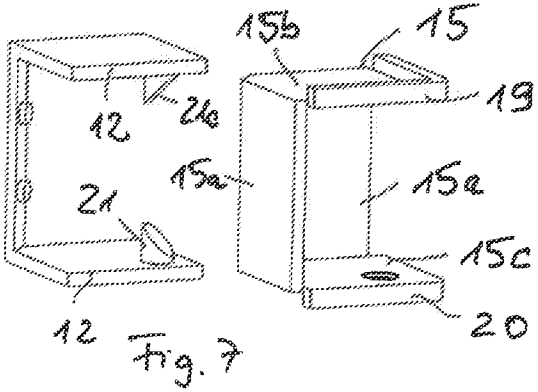
Figure 9:
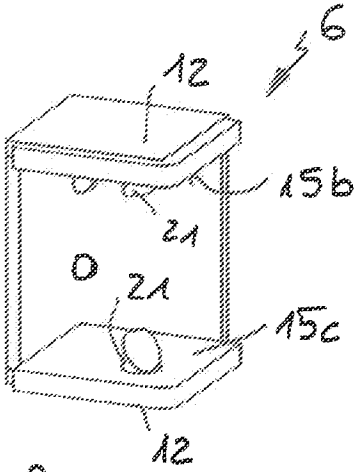
Figure 6:
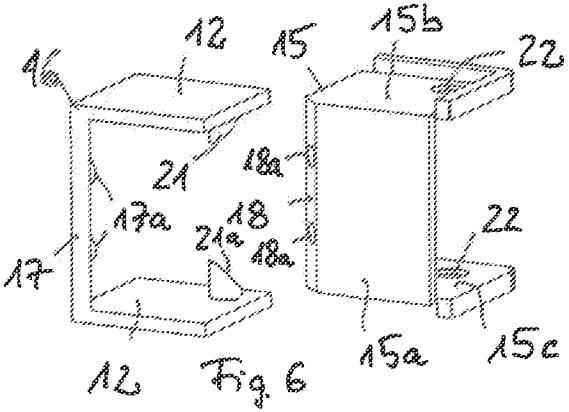
Figure 8:
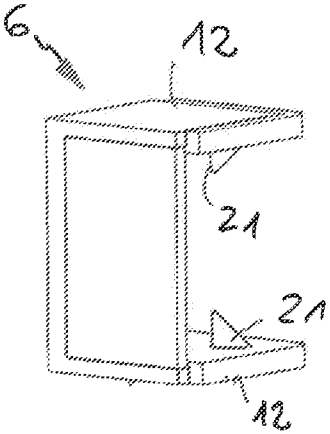
Figure 14:
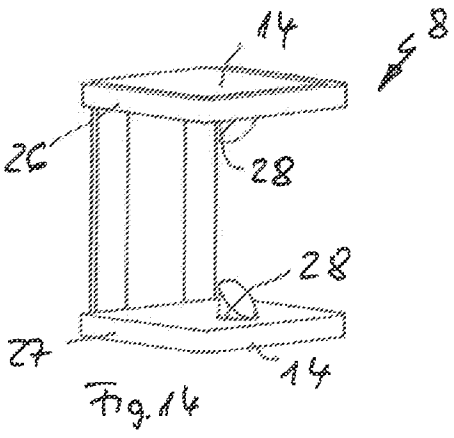
Figure 13:
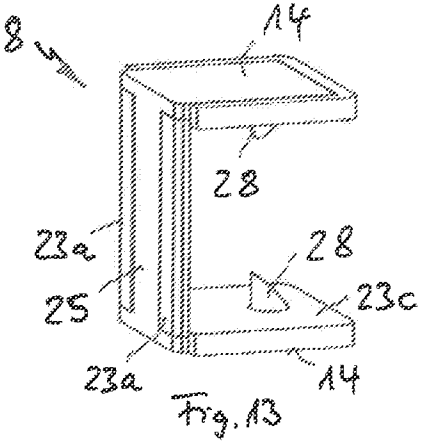

The invention will be explained in greater detail below, with examples, using the drawing. The drawing shows, in FIG. 1*a*-1*d* an assembly sequence of a shelf unit, FIG. 2 a detail II in FIG. 1*a*, FIG. 3 a detail III in FIG. 1*b*, FIG. 4 a detail IV in FIG. 1*a*, FIG. 5*a*-5*d* an assembly sequence of a corner region of a shelf, with a two-part corner connector according to a first embodiment, FIG. 6 a first exploded representation of the two-part corner connector according to the first embodiment, FIG. 7 a second exploded representation of the corner connector according to FIG. 6, FIG. 8 a first perspective representation of the corner connector according to FIG. 6, FIG. 9 a second perspective representation of the corner connector according to FIG. 6, FIG. 10*a*-10*d* an assembly sequence of a side edge of a shelf, FIG. 11 a first exploded representation of a two-part side connector according to a first embodiment, FIG. 12 a second exploded representation of the side connector according to FIG. 11, FIG. 13 a first perspective representation of the side connector according to FIG. 11, FIG. 14 a second perspective representation of the side connector according to FIG. 11, FIG. 15 a first perspective representation of the corner connector according to FIG. 6 in a one-piece embodiment, FIG. 16 a second perspective representation of the corner connector according to FIG. 15, FIG. 17 a first perspective representation of the side connector according to FIG. 11, in a one-piece embodiment, FIG. 18 a second perspective representation of the side connector according to FIG. 17, FIG. 19*a*-19*d* an assembly sequence of a corner region of a shelf, using a corner connector according to a second embodiment, FIG. 20 a first perspective representation of the corner connector according to the second embodiment, FIG. 21 a second perspective representation of the corner connector according to FIG. 20, and FIG. 22 a third perspective representation of the corner connector according to FIG. 20.

In the following figure description, a shelf unit will be described as an example of a piece of furniture.

The shelf unit is referred to, in general, with 1 in FIG. 1*d*, and after completion of the assembly, it is shown lying on a floor surface. In the position of use, the shelf unit 1 has vertically arranged supporting posts 2 and rectangular shelves 3, which are arranged one above the other. The supporting posts 2 are arranged in the four corners of the shelves 3. If the shelves 3, as shown, are relatively large and/or wide, additional supporting posts 4 can be provided, which are connected with the shelves 3, on the side.

The supporting posts 2 have corner cutouts 5 over their height. In this regard, the supporting posts 2 are preferably formed from rectangular or square hollow profiles, e.g. made of aluminum. In the case of this embodiment as a hollow profile, the corner cutouts 5 are formed by means of free cuts of two adjacent side walls 2*a*, 2*b* of the supporting post 2, in each instance.

To connect the shelves 3 to the supporting posts 2, corner connectors 6 are provided, which are inserted into the corresponding corner cutout 5 with shape fit and/or force fit. Each corner connector 6 engages around a corner region 3*a* of a shelf 3 and is fastened to it, preferably on the upper side and underside.

The additional supporting posts 4 have side cutouts 7 over their height. In this regard, the additional supporting posts 4 are preferably formed from rectangular or square hollow profiles, e.g. made of aluminum. In the case of this embodiment as a hollow profile, the side cutouts 7 are formed by means of free cuts of three side walls 4*a*, 4*b*, 4*c* of the corresponding additional supporting post 4.

To connect the shelves 3 to the additional supporting posts 4, side connectors 8 are provided, which are inserted into the corresponding side cutout 7 with shape fit and/or force fit.

Each side connector 8 engages around a side edge 3*b* of a shelf 3, and is preferably fastened to it on the upper side and underside.

For assembly of the shelf unit 1, in the case of the exemplary embodiment shown, first, according to FIG. 1*a*, two supporting posts 2 and, between them, two additional supporting posts 4 are laid down onto a floor surface, parallel and at a suitable distance from one another. Depending on the embodiment of the corner connectors 6 and the side connectors 8, the corner connectors 6 and the side connectors 8 are first inserted into the corner cutouts 5 and the side cutouts 7 with shape fit and/or force fit, and subsequently the shelves 3 are inserted into the corner connectors 6 and the side connectors 8 with their corner regions 3*a* and their side edges 3*b*, or the corner connectors 6 and the side connectors 8 are first set onto the shelves 3 and fastened to them, and subsequently the shelves 3, outfitted in this manner with the corner connectors 6 and the side connectors 8, are inserted into the corner cutouts 5 and the side cutouts 7, with shape fit and/or force fit.

Subsequently, according to FIG. 1*c*, in a corresponding manner, two supporting posts 2 and two additional supporting posts 4 are connected to the other corner regions 3*a* and side edges 3*b* of the shelves 3. Subsequently, an upper shelf 9 and a lower shelf 10 can be fastened onto the upper and the lower end of the supporting posts 2 and of the additional supporting posts 4, in a different, suitable manner. This situation is shown in FIG. 1*d*. From this final assembly position, the shelf unit 1 is set upright, so that the supporting posts 2 and the additional supporting posts 4 are oriented vertically and the shelves 3 are oriented horizontally.

The corner connectors 6 and the side connectors 8 can be formed in different ways. Each corner connector 6 preferably has, on the upper side and underside, in each instance, a wall region 12 that engages into a hollow space 11 of the hollow profile of the supporting post 2, bordering on the corner cutout 5, with shape fit and/or force fit. Each side connector 8 preferably has, on the upper side and underside, in each instance, a wall region 14 that engages into a hollow space 13 of the hollow profile of the additional supporting post 4, bordering on the side cutout 7, with shape fit and/or force fit.

In FIGS. 6 to 9 as well as 5*a* to 5*d*, a first embodiment of a corner connector 6 is shown, which is configured in two parts.

This corner connector 6 has a basic body 15 that engages around the corner region 3*a* of a shelf 3, and an outer body 16. The basic body 15 has two adjacent side walls 15*a*, a cover wall 15*b*, and a shelf wall 15*c*. The outer body 16 engages around the basic body 15 on the outside, and has the wall region 12, on the upper side and underside, in each instance, which engages into the hollow space 11 of the hollow profile of the supporting post 2 with shape fit and/or force fit. The two wall regions 12 are connected to one another by way of a crosspiece 17, which lies against an outer edge 18 in the transition region of the two side walls 15*a* of the basic body 15. The contact surfaces of the crosspiece 17 and the outer edge 18 are preferably oriented parallel to one another, preferably at a 45° angle to the side walls 15*a*. On the crosspiece 17, projections 17*a* can be formed, which engage into corresponding recesses 18*a* in the outer edge 18, or vice versa.

The corner connector 6, in each instance, has side edges 19, 20 on the basic body 15, bordering on the cover wall 15*b* and the shelf wall 15*c*, the outside of which edges align with the related side wall of the supporting post 2, as can be seen, for example, in FIG. 5*c*.

The corner connector 6, in each instance, according to the first embodiment, preferably has, on the upper side and underside, a crosspiece 21 directed inward toward the shelf 3, which crosspiece engages into a corresponding dead-end bore 3*c* of the shelf 3. These crosspieces 21 are formed on the wall regions 12 of the outer body 16, and project through openings 22 in the cover wall 15*b* and/or of the shelf wall 15*c* of the basic body 15, into the interior of the corner connector 6.

For shelf unit assembly, in accordance with the sequence of FIGS. 5*a* to 5*d*, first the corner connector 6 is inserted into the corner cutouts 5 of the supporting posts 2. In this regard, the corner connectors 6 engage into the hollow space 11 of the supporting post 2, in each instance, with shape fit and/or force fit, with their wall regions 12. Subsequently, the shelf 3, in each instance, is inserted into the basic body 15 of the corner connector 6 with its corner region 3*a*. For this purpose, the crosspieces 21 are preferably slanted (slant 21*a*) and configured to be slightly longer than the depth of the dead-end bores 3*c* in the corresponding shelf 3. This leads to the result that after engagement of the crosspiece 21, in each instance, into the dead-end bore 3*c*, the related wall region 12 is pressed into the hollow space 11 of the supporting post 2, locking it in place.

In FIGS. 11 to 14, as well as 10*a* to 10*d*, a first embodiment of a side connector 8 is shown, which is configured in two parts. This side connector 8 has a side basic body 23 that engages around the side edge 3*a* of a shelf 3, and a side outer body 24. The side basic body 23 has a side wall formed by two crosspieces 23*a* that are spaced apart from one another, a cover wall 23*b*, and a shelf wall 23*c*. The side outer body 24 engages around the side basic body 23 on the outside and has, on the upper side and underside, in each instance, the wall region 14 that engages into the hollow space 13 of the hollow profile of the additional supporting post 4, with shape fit and/or force fit. The two wall regions 14 are connected to one another by way of a crosspiece 25, which lies against the side basic body 23 between the two crosspieces 23*a*.

Figures 10A, 10B, 10C, 10D, 11, 12:
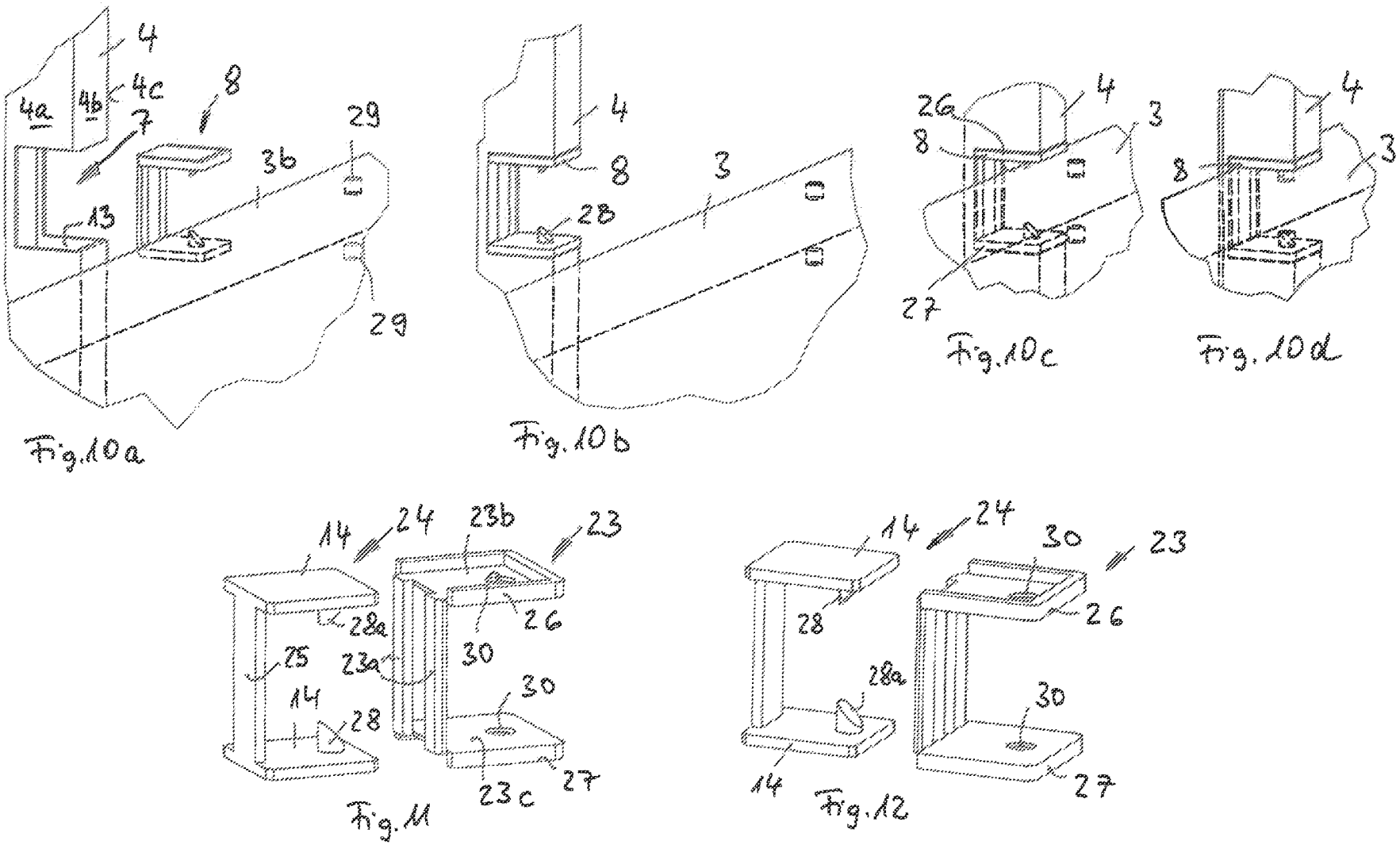

The side connector 8, in each instance, has side edges 26, 27 on the side basic body 23, bordering on the cover wall 23*b* and the shelf wall 23*c*, the outside of which edges align with the related side wall of the additional supporting post 4, as can be seen, for example, in FIG. 10*c*.

The side connector 8, in each instance, according to the first embodiment, preferably has, on the upper side and underside, a crosspiece 28 directed inward toward the shelf 3, which crosspiece engages into a corresponding dead-end bore 29 of the shelf 3. These crosspieces 28 are formed on the wall regions 14 of the side outer body 24, and project through openings 30 in the cover wall 23*b* and/or the shelf wall 23*c* of the side basic body 23, into the interior of the side connector 8.

For shelf unit assembly, according to the sequence of FIGS. 10*a* to 10*d*, first the side connectors 8 are inserted into the side cutouts 7 of the additional supporting posts 4. In this regard, the side connectors 8 engage, with shape fit and/or force fit, with their wall regions 14, into the hollow space 13, in each instance, of the additional supporting post 4. Subsequently, the shelf 3, in each instance, is inserted into the side basic body 15 of the side connector 8 with its side edge 3*b*. For this purpose, the crosspieces 28 are preferably slanted (slant 28*a*), and preferably configured to be somewhat longer than the depth of the dead-end bores 29 in the corresponding shelf 3. This leads to the result that after engagement of the crosspiece 28 into the dead-end bore 29, the related wall region 14 is pressed into the hollow space 13 of the additional supporting post 4, locking it in place.

Figure 16:
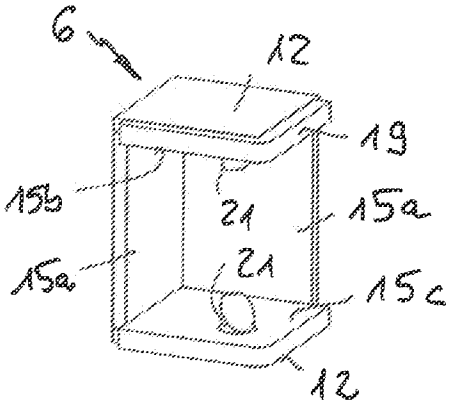
Figure 15:
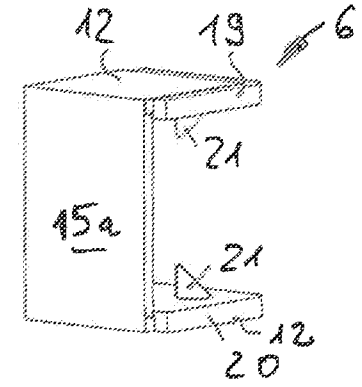

The corner connector 6 according to the first embodiment can also be formed in one piece, as shown in FIGS. 15 and 16. The additional outer body 16 is then eliminated, and the corner connector 6 consists, in principle, only of the basic body 15, with a wall region 12 formed directly on the cover wall 15*b* and the shelf wall 15*c*, with crosspieces 21. The assembly sequence does not change as a result.

Figure 18:
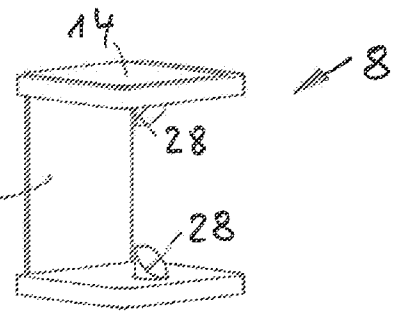
Figure 17:
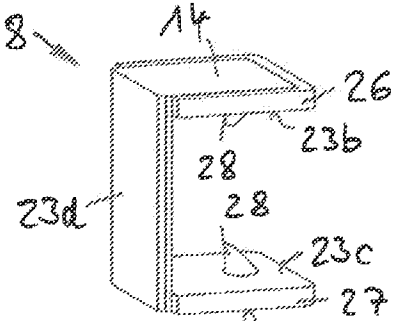

The side connector 8 according to the first embodiment can also be formed in one piece, as shown in FIGS. 17 and 18. The additional side outer body 24 is then eliminated, and the side connector 8 consists, in principle, only of the side basic body 23, with a wall region 14 formed directly on the cover wall 23*b* and the shelf wall 23*c*, with crosspieces 28. The side wall 23*d* is then formed over the full area. The assembly sequence does not change as a result.

Figure 22:
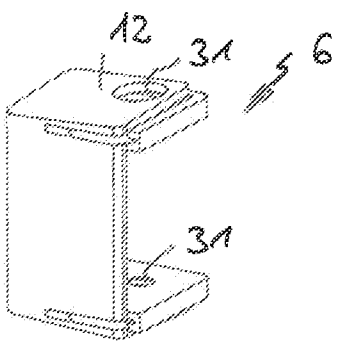
Figure 21:
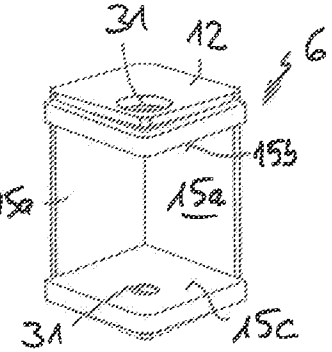
Figure 20:
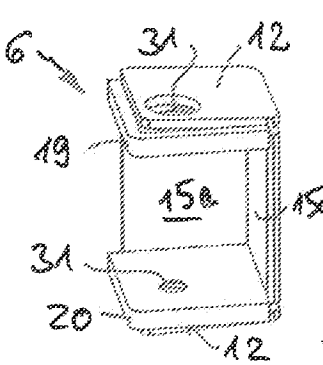

In FIGS. 20 to 22 as well as 19*a* to 19*d*, a second embodiment of a corner connector 6 is shown, which is connected to the shelf 3 in a different way. This corner connector 6 can also be formed in one piece or two pieces; it is shown in a one-piece form. The corner connector 6 has two side walls 15*a* as well as a cover wall 15*b* and a shelf wall 15*c*. The wall region 12 is formed on the cover wall 15*b* and the shelf wall 15*c*, on the outside, in each instance. In the cover wall 15*b* and in the shelf wall 15*c*, a push-through opening 31 for a fastening screw 32 is formed, in each instance, which screw has a screw head indicated as 32*a*. The diameter of the push-through opening 31 is less than the outside diameter of the screw head 32*a*. In the wall region 12, in each instance, the diameter of the push-through opening 31 widens in such a manner that the screw head 32*a* is countersunk into this region in its screwed-in position, and does not impair the engagement of the wall region 12 into the hollow space 11.

Figure 19D:
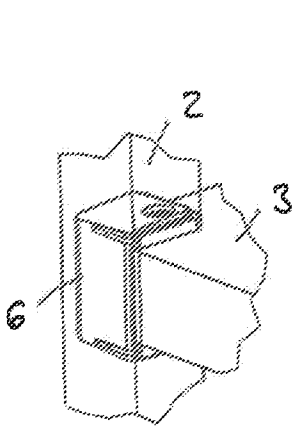
Figure 19C:
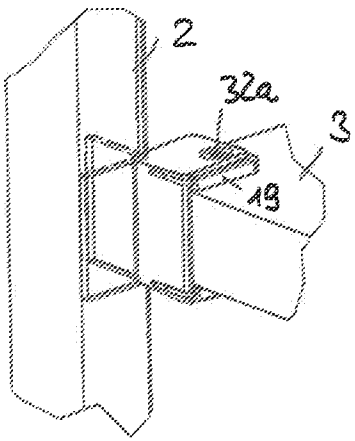
Figure 19B:
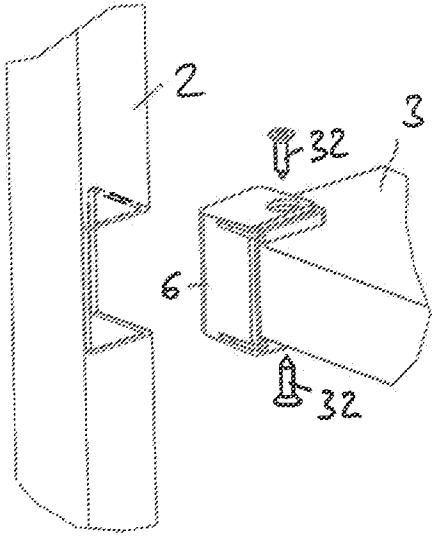
Figure 19A:
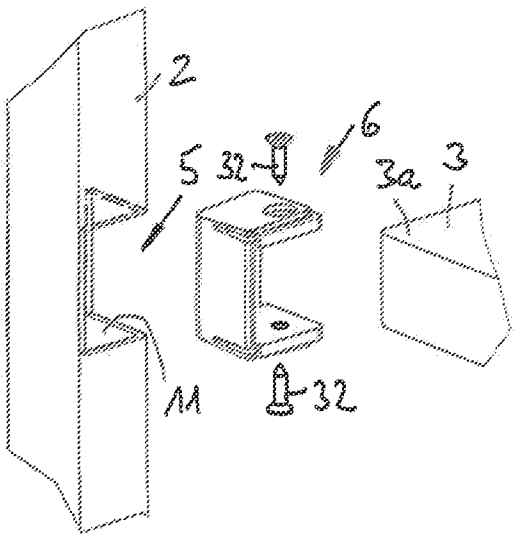

During assembly, according to FIGS. 19*a* to 19*c*, first the corner connector 6 is set onto the corner region 3*a* of the shelf 3, and then it is fastened to the shelf 3 by means of the fastening screws 32. Subsequently, according to FIG. 19*d*, the shelf 3 is inserted into corner cutout with the corner connector 6, locking it in place.

Of course, the invention is not restricted to the exemplary embodiments shown. Further embodiments are possible, without departing from the basic idea. The corner connector 6 according to the second embodiment can also be configured in two parts. Furthermore, the side connector 8 can also be fastened to the shelf by means of a screw connection, analogous to the corner connector 6 according to the second embodiment. Such a side connector 8 can also be configured in one or two parts. The shelf unit 1 can be equipped, entirely or in part, with rear and/or side walls or doors, drawers and the like. Furthermore, the shelf unit 1 can also be connected to a box-shaped, carcass-like lower part, on which the supporting posts 2 and, if applicable, the additional supporting posts 4 stand and are connected to the lower part. The lower part can be configured, for example, for the distribution of electrical cables or data cables, which can be guided to any desired locations of the shelf unit 1, through bores in the shelves 3. For this purpose, the lower part can also have cable troughs or the like.

REFERENCE SYMBOL LIST

1 shelf unit
2 supporting posts
2*a* side wall
2*b* side wall
3 shelf
3*a* corner region
3*b* side edge
3*c* dead-end bore
4 additional supporting post
4 a side wall
4*b* side wall
4*c* side wall
5 corner cutout
6 corner connector
7 side cutout
8 side connector
9 top shelf
10 bottom shelf
11 cavity
12 wall region
13 hollow space
14 wall region
15 basic body
15*a* side wall
15*b* cover wall
15*c* shelf wall
16 outer body
17 crosspiece
17*a* projection
18 outer edge
18*a* recess
19 side edge
20 side edge
21 crosspiece
21*a* slant
22 opening
23 side basic body
23*a* crosspieces
23*b* cover wall
23*c* shelf wall
23*d* side wall
24 side outer body
25 crosspiece
26 side edge
27 side edge
28 crosspiece
28*a* slant
29 dead-end bore
30 opening
31 push-through opening
32 fastening screw
32*a* screw head

The invention claimed is:

1. A piece of furniture having polygonal shelves and vertical supporting posts, wherein each shelf is connected, in its corner regions, with a supporting post, in each instance, wherein the supporting posts have corner cutouts over their height, into which corner connectors are inserted with shape fit and/or force fit, wherein each corner connector engages around a corner region of a shelf and is fastened on the upper side and/or underside of the shelf, wherein the supporting post is formed by a hollow profile, in each instance, wherein the corner connector, in each instance, has a wall region that engages, with shape fit and force fit, on the upper side and/or underside, into a hollow space of the hollow profile of the supporting post that borders on the corner cutout, which is dimensioned such that the wall region engages flexibly and/or elastically in certain regions in the hollow profile.

2. The piece of furniture according to claim 1, wherein the supporting post, in each instance, has a rectangular cross-section, and the corner cutout, in each instance, is formed by free cuts of two adjacent side walls.

3. The piece of furniture according to claim 1, wherein the corner connector, in each instance, has a crosspiece on the upper side and/or on the underside, wherein the crosspiece is directed inward toward the shelf, and engages into a corresponding dead-end bore of the shelf.

4. The piece of furniture according to claim 1, wherein the corner connector, in each instance, has a push-through opening on the upper side and/or on the underside, through which a screw head is screwed into the shelf.

5. The piece of furniture according to claim 1, wherein the corner connector, in each instance, is configured in two parts, with a basic body that engages around the corner region of a shelf, and an outer body, wherein the basic body has side walls, a cover wall, and a shelf wall, and the outer body engages around the basic body, on the outside, and has a wall region, on the upper side and the underside, in each instance, that engages into the hollow space of the hollow profile of the supporting post, with shape fit and force fit.

6. The piece of furniture according to claim 1, wherein the corner connector, in each instance, has side edges, wherein the outside of the side edges lie flush with the related side wall of the supporting post.

7. The piece of furniture according to claim 1, wherein additional supporting posts are provided, which have side cutouts over their height, into which side connectors are inserted with shape fit and/or force fit, wherein each side connector engages around a side edge of a shelf, and is attached to the shelf on the upper side and/or on the underside.

8. The piece of furniture according to claim 7, wherein the additional supporting post, in each instance, is formed by a hollow profile, and the side connector, in each instance, has a wall region, on the upper side and/or on the underside, wherein the wall region engages into a hollow space of the hollow profile of the additional supporting post, bordering on the side cutout, with shape fit and/or force fit.

9. The piece of furniture according to claim 7, wherein the additional supporting post, in each instance, has a rectangular cross-section, and the side cutout, in each instance, is formed by free cuts of three side walls.

10. The piece of furniture according to claim 7, wherein the side connector, in each instance, has a crosspiece, on the upper side and/or underside, which is directed inward toward the shelf, and engages into a corresponding dead-end bore of the shelf.

11. The piece of furniture according to claim 7, wherein the side connector, in each instance, has a push-through opening on the upper side and/or underside, through which a fastening screw is screwed into the shelf.

12. The piece of furniture according to claim 7, wherein the side connector, in each instance, is configured in two parts, with a side basic body that engages around a side edge of a shelf, and a side outer body, wherein the side basic body has a side wall, a cover wall, and a shelf wall, and the side outer body engages around the side basic body on the outside, and has the wall region, on the upper side and on the underside, in each instance, that engages into the hollow space of the hollow profile of the additional supporting post, with shape fit and/or force fit.

* * * * *